US006331056B1

(12) United States Patent
Nohr et al.

(10) Patent No.: US 6,331,056 B1
(45) Date of Patent: Dec. 18, 2001

(54) PRINTING APPARATUS AND APPLICATIONS THEREFOR

(75) Inventors: Ronald S. Nohr, Alpharetta; John G. MacDonald, Decatur, both of GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/512,506

(22) Filed: Feb. 24, 2000

Related U.S. Application Data

(60) Provisional application No. 60/121,560, filed on Feb. 25, 1999.

(51) Int. Cl.[7] ..... B41J 2/01
(52) U.S. Cl. ..... 347/102; 347/101
(58) Field of Search ..... 347/102, 101

(56) References Cited

U.S. PATENT DOCUMENTS

| | | |
|---|---|---|
| Re. 28,225 | 11/1974 | Heseltine et al. . |
| Re. 28,789 | 4/1976 | Chang . |
| 575,228 | 1/1897 | von Gallois . |
| 582,853 | 5/1897 | Feer . |
| 893,636 | 7/1908 | Maywald . |
| 1,013,544 | 1/1912 | Fuerth . |
| 1,325,971 | 12/1919 | Akashi . |
| 1,364,406 | 1/1921 | Olsen . |
| 1,436,856 | 11/1922 | Brenizer et al. . |
| 1,744,149 | 1/1930 | Staehlin . |
| 1,803,906 | 5/1931 | Krieger et al. . |
| 1,844,199 | 2/1932 | Bicknell et al. . |
| 1,876,880 | 9/1932 | Drapal . |
| 1,880,572 | 10/1932 | Wendt et al. . |
| 1,880,573 | 10/1932 | Wendt et al. . |
| 1,916,350 | 7/1933 | Wendt et al. . |
| 1,916,779 | 7/1933 | Wendt et al. . |
| 1,955,898 | 4/1934 | Wendt et al. . |
| 1,962,111 | 6/1934 | Bamberger . |
| 2,005,378 | 6/1935 | Kiel . |
| 2,005,511 | 6/1935 | Stoll et al. . |
| 2,049,005 | 7/1936 | Gaspar . |
| 2,054,390 | 9/1936 | Rust et al. . |
| 2,058,489 | 10/1936 | Murch et al. . |
| 2,062,304 | 12/1936 | Gaspar . |
| 2,090,511 | 8/1937 | Crossley et al. . |
| 2,097,119 | 10/1937 | Eggert . |
| 2,106,539 | 1/1938 | Schnitzspahn . |
| 2,111,692 | 3/1938 | Saunders et al. . |
| 2,125,015 | 7/1938 | Gaspar . |
| 2,130,572 | 9/1938 | Wendt . |
| 2,132,154 | 10/1938 | Gaspar . |
| 2,145,960 | 2/1939 | Wheatley et al. . |
| 2,154,996 | 4/1939 | Rawling . |
| 2,159,280 | 5/1939 | Mannes et al. . |

(List continued on next page.)

FOREIGN PATENT DOCUMENTS

| | | |
|---|---|---|
| 103085 | 4/1937 | (AU) . |
| 12624/88 | 9/1988 | (AU) . |
| 620075 | 5/1962 | (BE) . |

(List continued on next page.)

OTHER PUBLICATIONS

Noguchi, H. UV Curable, Aqueous Ink Jet Ink: Material Design and Performance for Digital Printing 1998 International Conf. on Digital Printing Technologies 107–110, 1998.

(List continued on next page.)

*Primary Examiner*—Thinh Nguyen
*Assistant Examiner*—Manish S. Shah
(74) *Attorney, Agent, or Firm*—Kilpatrick Stockton LLP

(57) ABSTRACT

The present invention relates to a novel printing apparatus and methods for using the same. The present invention further relates to a method of curing photocurable inks, as used in ink jet printers and other printing apparatus, by exposing the photocurable ink to a radiation source, particularly a flat excimer lamp.

21 Claims, 1 Drawing Sheet

U.S. PATENT DOCUMENTS

| | | |
|---|---|---|
| 2,171,976 | 9/1939 | Erickson . |
| 2,181,800 | 11/1939 | Crossley et al. . |
| 2,185,153 | 12/1939 | Lecher et al. . |
| 2,220,178 | 11/1940 | Schneider . |
| 2,230,590 | 2/1941 | Eggert et al. . |
| 2,237,885 | 4/1941 | Markush et al. . |
| 2,243,630 | 5/1941 | Houk et al. . |
| 2,268,324 | 12/1941 | Polgar . |
| 2,281,895 | 5/1942 | van Poser et al. . |
| 2,328,166 | 8/1943 | Poigar et al. . |
| 2,346,090 | 4/1944 | Staehle . |
| 2,349,090 | 5/1944 | Haddock . |
| 2,356,618 | 8/1944 | Rossander et al. . |
| 2,361,301 | 10/1944 | Libby, Jr. et al. . |
| 2,364,359 | 12/1944 | Kienle et al. . |
| 2,381,145 | 8/1945 | von Glahn et al. . |
| 2,382,904 | 8/1945 | Federsen . |
| 2,386,646 | 10/1945 | Adams et al. . |
| 2,402,106 | 6/1946 | von Glahn et al. . |
| 2,416,145 | 2/1947 | Biro . |
| 2,477,165 | 7/1949 | Bergstrom . |
| 2,527,347 | 10/1950 | Bergstrom . |
| 2,580,461 | 1/1952 | Pearl . |
| 2,601,669 | 6/1952 | Tullsen . |
| 2,612,494 | 9/1952 | von Glahn et al. . |
| 2,612,495 | 9/1952 | von Glahn et al. . |
| 2,628,959 | 2/1953 | von Glahn et al. . |
| 2,647,080 | 7/1953 | Joyce . |
| 2,680,685 | 6/1954 | Ratchford . |
| 2,728,784 | 12/1955 | Tholstrup et al. . |
| 2,732,301 | 1/1956 | Robertson et al. . |
| 2,744,103 | 5/1956 | Koch . |
| 2,757,090 | 7/1956 | Meugebauer et al. . |
| 2,763,550 | 9/1956 | Lovick . |
| 2,768,171 | 10/1956 | Clarke et al. . |
| 2,773,056 | 12/1956 | Helfaer . |
| 2,798,000 | 7/1957 | Monterman . |
| 2,809,189 | 10/1957 | Stanley et al. . |
| 2,827,358 | 3/1958 | Kaplan et al. . |
| 2,834,773 | 5/1958 | Scalera et al. . |
| 2,875,045 | 2/1959 | Lurie . |
| 2,892,865 | 6/1959 | Giraldi et al. . |
| 2,897,187 | 7/1959 | Koch . |
| 2,936,241 | 5/1960 | Sharp et al. . |
| 2,940,853 | 6/1960 | Sagura et al. . |
| 2,955,067 | 10/1960 | McBurney et al. . |
| 2,992,129 | 7/1961 | Gauthier . |
| 2,992,198 | 7/1961 | Funahashi . |
| 3,030,208 | 4/1962 | Schellenberg et al. . |
| 3,071,815 | 1/1963 | MacKinnon . |
| 3,075,014 | 1/1963 | Palopoli et al. . |
| 3,076,813 | 2/1963 | Sharp . |
| 3,104,973 | 9/1963 | Sprague et al. . |
| 3,114,634 | 12/1963 | Brown et al. . |
| 3,121,632 | 2/1964 | Sprague et al. . |
| 3,123,647 | 3/1964 | Duennenberger et al. . |
| 3,133,049 | 5/1964 | Hertel et al. . |
| 3,140,949 | 7/1964 | Sprague et al. . |
| 3,154,416 | 10/1964 | Fidelman . |
| 3,155,509 | 11/1964 | Roscow . |
| 3,175,905 | 3/1965 | Wiesbaden . |
| 3,178,285 | 4/1965 | Anderau et al. . |
| 3,238,163 | 3/1966 | O'Neill . |
| 3,242,215 | 3/1966 | Heitmiller . |
| 3,248,337 | 4/1966 | Zirker et al. . |
| 3,266,973 | 8/1966 | Crowley . |
| 3,282,886 | 11/1966 | Gadecki . |
| 3,284,205 | 11/1966 | Sprague et al. . |
| 3,300,314 | 1/1967 | Rauner et al. . |
| 3,304,297 | 2/1967 | Wegmann et al. . |
| 3,305,361 | 2/1967 | Gaynor et al. . |
| 3,313,797 | 4/1967 | Kissa . |
| 3,320,080 | 5/1967 | Mazzarella et al. . |
| 3,330,659 | 7/1967 | Wainer . |
| 3,341,492 | 9/1967 | Champ et al. . |
| 3,359,109 | 12/1967 | Harder et al. . |
| 3,361,827 | 1/1968 | Biletch . |
| 3,363,969 | 1/1968 | Brooks . |
| 3,385,700 | 5/1968 | Willems et al. . |
| 3,397,984 | 8/1968 | Williams et al. . |
| 3,415,875 | 12/1968 | Luethi et al. . |
| 3,418,118 | 12/1968 | Thommes et al. . |
| 3,445,234 | 5/1969 | Cescon et al. . |
| 3,453,258 | 7/1969 | Parmerter et al. . |
| 3,453,259 | 7/1969 | Parmerter et al. . |
| 3,464,841 | 9/1969 | Skofronick . |
| 3,467,647 | 9/1969 | Benninga . |
| 3,479,185 | 11/1969 | Chambers . |
| 3,488,269 | 1/1970 | Allen et al. . |
| 3,502,476 | 3/1970 | Kohei et al. . |
| 3,503,744 | 3/1970 | Itano et al. . |
| 3,514,597 | 5/1970 | Haes et al. . |
| 3,541,142 | 11/1970 | Cragoe, Jr. . |
| 3,546,161 | 12/1970 | Wolheim . |
| 3,547,646 | 12/1970 | Hori et al. . |
| 3,549,367 | 12/1970 | Chang et al. . |
| 3,553,710 | 1/1971 | Lloyd et al. . |
| 3,563,931 | 2/1971 | Horiguchi . |
| 3,565,753 | 2/1971 | Yurkowitz . |
| 3,574,624 | 4/1971 | Reynolds et al. . |
| 3,579,533 | 5/1971 | Yalman . |
| 3,595,655 | 7/1971 | Robinson et al. . |
| 3,595,657 | 7/1971 | Robinson et al. . |
| 3,595,658 | 7/1971 | Gerlach et al. . |
| 3,595,659 | 7/1971 | Gerlach et al. . |
| 3,607,639 | 9/1971 | Krefeld et al. . |
| 3,607,693 | 9/1971 | Heine et al. . |
| 3,607,863 | 9/1971 | Dosch . |
| 3,615,562 | 10/1971 | Harrison et al. . |
| 3,617,288 | 11/1971 | Hartman et al. . |
| 3,617,335 | 11/1971 | Kumura et al. . |
| 3,619,238 | 11/1971 | Kimura et al. . |
| 3,619,239 | 11/1971 | Osada et al. . |
| 3,637,337 | 1/1972 | Pilling . |
| 3,637,581 | 1/1972 | Horioguchi et al. . |
| 3,642,472 | 2/1972 | Mayo . |
| 3,647,467 | 3/1972 | Grubb . |
| 3,652,275 | 3/1972 | Baum et al. . |
| 3,660,542 | 5/1972 | Adachi et al. . |
| 3,667,954 | 6/1972 | Itano et al. . |
| 3,668,188 | 6/1972 | King et al. . |
| 3,669,925 | 6/1972 | King et al. . |
| 3,671,096 | 6/1972 | Mackin . |
| 3,671,251 | 6/1972 | Houle et al. . |
| 3,676,690 | 7/1972 | McMillin et al. . |
| 3,678,044 | 7/1972 | Adams . |
| 3,689,565 | 9/1972 | Hoffmann et al. . |
| 3,694,241 | 9/1972 | Guthrie et al. . |
| 3,695,879 | 10/1972 | Laming et al. . |
| 3,697,280 | 10/1972 | Strilko . |
| 3,705,043 | 12/1972 | Zablak . |
| 3,707,371 | 12/1972 | Files . |
| 3,729,313 | 4/1973 | Smith . |
| 3,737,628 | 6/1973 | Azure . |
| 3,765,896 | 10/1973 | Fox . |
| 3,775,130 | 11/1973 | Enomoto et al. . |
| 3,788,849 | 1/1974 | Taguchi et al. . |
| 3,799,773 | 3/1974 | Watarai et al. . |
| 3,800,439 | 4/1974 | Sokolski et al. . |
| 3,801,329 | 4/1974 | Sandner et al. . |
| 3,870,524 | 3/1975 | Watanabe et al. . |

3,873,500 3/1975 Kato et al. .
3,876,496 4/1975 Lozano .
3,887,450 6/1975 Gilano et al. .
3,895,949 7/1975 Akamatsu .
3,901,779 8/1975 Mani .
3,904,562 9/1975 Hopfenberg et al. .
3,910,993 10/1975 Avar et al. .
3,914,165 10/1975 Gaske .
3,914,166 10/1975 Rudolph et al. .
3,915,824 10/1975 McGinniss .
3,919,323 11/1975 Houlihan et al. .
3,926,641 12/1975 Rosen .
3,928,264 12/1975 Young, Jr. et al. .
3,933,682 1/1976 Bean .
3,952,129 4/1976 Matsukawa et al. .
3,960,685 6/1976 Sano et al. .
3,965,157 6/1976 Harrison .
3,978,132 8/1976 Houlihan et al. .
3,984,248 10/1976 Sturmer .
3,988,154 10/1976 Sturmer .
4,004,998 1/1977 Rosen .
4,012,256 3/1977 Levinos .
4,017,652 4/1977 Gruber .
4,022,674 5/1977 Rosen .
4,024,324 5/1977 Sparks .
4,039,332 8/1977 Kokelenberg et al. .
4,043,819 8/1977 Baumann .
4,048,034 9/1977 Martan .
4,054,719 10/1977 Cordes, III .
4,056,665 11/1977 Tayler et al. .
4,058,400 11/1977 Crivello .
4,067,892 1/1978 Thorne et al. .
4,071,424 1/1978 Dart et al. .
4,073,968 2/1978 Miyamoto et al. .
4,077,769 3/1978 Garcia .
4,079,183 3/1978 Green .
4,085,062 4/1978 Virgilio et al. .
4,090,877 5/1978 Streeper .
4,100,047 7/1978 McCarty .
4,105,572 8/1978 Gorondy .
4,107,733 8/1978 Schickedanz .
4,110,112 8/1978 Roman et al. .
4,111,699 9/1978 Krueger .
4,114,028 9/1978 Baio et al. .
4,126,412 11/1978 Masson et al. .
4,132,562 1/1979 Burke, Jr. et al. .
4,141,807 2/1979 Via .
4,144,156 3/1979 Kuesters et al. .
4,148,658 4/1979 Kondoh et al. .
4,162,162 7/1979 Dueber .
4,171,977 10/1979 Hasegawa et al. .
4,179,577 12/1979 Green .
4,181,807 1/1980 Green .
4,190,671 2/1980 Vanstone et al. .
4,197,080 4/1980 Mee .
4,199,420 4/1980 Photis .
4,229,172 10/1980 Baumann et al. .
4,232,106 11/1980 Iwasaki et al. .
4,238,492 12/1980 Majoie .
4,239,843 12/1980 Hara et al. .
4,239,850 12/1980 Kita et al. .
4,241,155 12/1980 Hara et al. .
4,242,430 12/1980 Hara et al. .
4,242,431 12/1980 Hara et al. .
4,245,018 1/1981 Hara et al. .
4,245,033 1/1981 Eida et al. .
4,245,995 1/1981 Hugl et al. .
4,246,330 1/1981 Hara et al. .
4,248,949 2/1981 Hara et al. .
4,250,096 2/1981 Kvita et al. .
4,251,622 2/1981 Kimoto et al. .
4,251,662 2/1981 Ozawa et al. .
4,254,195 3/1981 Hara et al. .
4,256,493 3/1981 Yokoyama et al. .
4,256,817 3/1981 Hara et al. .
4,258,123 3/1981 Nagashima et al. .
4,258,367 3/1981 Mansukhani .
4,259,432 3/1981 Kondoh et al. .
4,262,936 4/1981 Miyamoto .
4,268,605 5/1981 Hara et al. .
4,268,667 5/1981 Anderson .
4,269,926 5/1981 Hara et al. .
4,270,130 5/1981 Houle et al. .
4,271,252 6/1981 Hara et al. .
4,271,253 6/1981 Hara et al. .
4,272,244 6/1981 Schlick .
4,276,211 6/1981 Singer et al. .
4,277,497 7/1981 Fromantin .
4,279,653 7/1981 Makishima et al. .
4,279,982 7/1981 Iwasaki et al. .
4,279,985 7/1981 Nonogaki et al. .
4,284,485 8/1981 Berner .
4,288,631 9/1981 Ching .
4,289,844 9/1981 Specht et al. .
4,290,870 9/1981 Kondoh et al. .
4,293,458 10/1981 Gruenberger et al. .
4,298,679 11/1981 Shinozaki et al. .
4,300,123 11/1981 McMillin et al. .
4,301,223 11/1981 Nakamura et al. .
4,302,606 11/1981 Barabas et al. .
4,303,924 * 12/1981 Young, Jr. ..... 347/102
4,306,014 12/1981 Kunikane et al. .
4,307,182 12/1981 Dalzell et al. .
4,308,400 12/1981 Felder et al. .
4,315,807 2/1982 Felder et al. .
4,318,705 3/1982 Nowak et al. .
4,318,791 3/1982 Felder et al. .
4,321,118 3/1982 Felder et al. .
4,335,054 6/1982 Blaser et al. .
4,335,055 6/1982 Blaser et al. .
4,336,323 6/1982 Winslow .
4,343,891 8/1982 Aasen et al. .
4,345,011 8/1982 Drexhage .
4,347,111 8/1982 Gehlhaus et al. .
4,349,617 9/1982 Kawashiri et al. .
4,350,753 9/1982 Shelnut et al. .
4,351,893 9/1982 Anderson .
4,356,247 10/1982 Aotani et al. .
4,356,255 10/1982 Tachikawa et al. .
4,357,468 11/1982 Szejtli et al. .
4,359,524 11/1982 Masuda et al. .
4,362,806 12/1982 Whitmore .
4,367,072 1/1983 Vogtle et al. .
4,367,280 1/1983 Kondo et al. .
4,369,283 1/1983 Altschuler .
4,370,401 1/1983 Winslow et al. .
4,372,582 2/1983 Geisler .
4,373,017 2/1983 Masukawa et al. .
4,373,020 2/1983 Winslow .
4,374,984 2/1983 Eichler et al. .
4,376,887 3/1983 Greenaway et al. .
4,383,835 5/1983 Preuss et al. .
4,390,616 6/1983 Sato et al. .
4,391,867 7/1983 Derick et al. .
4,399,209 8/1983 Sanders et al. .
4,400,173 8/1983 Beavan .
4,401,470 8/1983 Bridger .
4,416,961 11/1983 Drexhage .
4,421,559 12/1983 Owatari .
4,424,325 1/1984 Tsunoda et al. .
4,425,162 1/1984 Sugiyama .
4,425,424 1/1984 Altland et al. .

4,426,153 1/1984 Libby et al. .
4,434,035 2/1984 Eichler et al. .
4,440,827 4/1984 Miyamoto et al. .
4,447,521 5/1984 Tiers et al. .
4,450,227 5/1984 Holmes et al. .
4,460,676 7/1984 Fabel .
4,467,112 8/1984 Matsuura et al. .
4,475,999 10/1984 Via .
4,477,681 10/1984 Gehlhaus et al. .
4,489,334 12/1984 Owatari .
4,495,041 1/1985 Goldstein .
4,496,447 1/1985 Eichler et al. .
4,500,355 2/1985 Shimada et al. .
4,508,570 4/1985 Fugii et al. .
4,510,392 4/1985 Litt et al. .
4,523,924 6/1985 Lacroix .
4,524,122 6/1985 Weber et al. .
4,534,838 8/1985 Lin et al. .
4,548,896 10/1985 Sabongi et al. .
4,555,474 11/1985 Kawamura .
4,557,730 12/1985 Bennett et al. .
4,559,371 12/1985 Hiisler et al. .
4,564,560 1/1986 Tani et al. .
4,565,769 1/1986 Dueber et al. .
4,567,171 1/1986 Mangum .
4,571,377 2/1986 McGinniss et al. .
4,582,862 4/1986 Berner et al. .
4,595,745 6/1986 Nakano et al. .
4,604,344 8/1986 Irving et al. .
4,605,442 8/1986 Kawashita et al. .
4,613,334 9/1986 Thomas et al. .
4,614,723 9/1986 Schmidt et al. .
4,617,380 10/1986 Hinson et al. .
4,620,875 11/1986 Shimada et al. .
4,620,876 11/1986 Fugii et al. .
4,622,286 11/1986 Sheets .
4,631,085 12/1986 Kawanishi et al. .
4,632,891 12/1986 Banks et al. .
4,632,895 12/1986 Patel et al. .
4,634,644 1/1987 Irving et al. .
4,638,340 1/1987 Iiyama et al. .
4,647,310 3/1987 Shimada et al. .
4,655,783 4/1987 Reinert et al. .
4,663,275 5/1987 West et al. .
4,663,641 5/1987 Iiyama et al. .
4,668,533 5/1987 Miller .
4,672,041 6/1987 Jain .
4,698,291 10/1987 Koibuchi et al. .
4,701,402 10/1987 Patel et al. .
4,702,996 10/1987 Griffing et al. .
4,704,113 11/1987 Reinert et al. .
4,707,161 11/1987 Thomas et al. .
4,707,425 11/1987 Sasagawa et al. .
4,707,430 11/1987 Ozawa et al. .
4,711,668 12/1987 Shimada et al. .
4,711,802 12/1987 Tannenbaum .
4,713,113 12/1987 Shimada et al. .
4,720,450 1/1988 Ellis .
4,721,531 1/1988 Wildeman et al. .
4,721,734 1/1988 Gehlhaus et al. .
4,724,021 2/1988 Martin et al. .
4,724,201 2/1988 Okazaki et al. .
4,725,527 2/1988 Robillard .
4,727,824 3/1988 Ducharme et al. .
4,732,615 3/1988 Kawashita et al. .
4,737,190 4/1988 Shimada et al. .
4,737,438 4/1988 Ito et al. .
4,740,451 4/1988 Kohara .
4,745,042 5/1988 Sasago et al. .
4,746,735 5/1988 Kruper, Jr. et al. .
4,752,341 6/1988 Rock .
4,755,450 7/1988 Sanders et al. .
4,761,181 8/1988 Suzuki .
4,766,050 8/1988 Jerry .
4,766,055 8/1988 Kawabata et al. .
4,770,667 9/1988 Evans et al. .
4,772,291 9/1988 Shibanai et al. .
4,772,541 9/1988 Gottschalk .
4,775,386 10/1988 Reinert et al. .
4,786,586 11/1988 Lee et al. .
4,789,382 12/1988 Neumann et al. .
4,790,565 12/1988 Steed .
4,800,149 1/1989 Gottschalk .
4,803,008 2/1989 Ciolino et al. .
4,808,189 2/1989 Oishi et al. .
4,812,139 3/1989 Brodmann .
4,812,517 3/1989 West .
4,813,970 3/1989 Kirjanov et al. .
4,822,714 4/1989 Sanders .
4,831,068 5/1989 Reinert et al. .
4,834,771 5/1989 Yamauchi et al. .
4,837,106 6/1989 Ishikawa et al. .
4,837,331 6/1989 Yamanishi et al. .
4,838,938 6/1989 Tomida et al. .
4,839,269 6/1989 Okazaki et al. .
4,849,320 7/1989 Irving et al. .
4,853,037 8/1989 Johnson et al. .
4,853,398 8/1989 Carr et al. .
4,854,971 8/1989 Gane et al. .
4,857,438 8/1989 Loerzer et al. .
4,861,916 8/1989 Kohler et al. .
4,865,942 9/1989 Gottschalk et al. .
4,874,391 10/1989 Reinert .
4,874,899 10/1989 Hoelderich et al. .
4,885,395 12/1989 Hoelderich .
4,886,774 12/1989 Doi .
4,892,941 1/1990 Dolphin et al. .
4,895,880 1/1990 Gottschalk .
4,900,581 2/1990 Stuke et al. .
4,902,299 2/1990 Anton .
4,902,725 2/1990 Moore .
4,902,787 2/1990 Freeman .
4,911,732 3/1990 Neumann et al. .
4,911,899 3/1990 Hagiwara et al. .
4,917,956 4/1990 Rohrbach .
4,921,317 5/1990 Suzuki et al. .
4,925,770 5/1990 Ichiura et al. .
4,925,777 5/1990 Inoue et al. .
4,926,190 5/1990 Lavar .
4,933,265 6/1990 Inoue et al. .
4,933,948 6/1990 Herkstroeter .
4,937,161 6/1990 Kita et al. .
4,942,113 7/1990 Trundle .
4,944,988 7/1990 Yasuda et al. .
4,950,304 8/1990 Reinert et al. .
4,952,478 8/1990 Miyagawa et al. .
4,952,680 8/1990 Schmeidl .
4,954,380 9/1990 Kanome et al. .
4,954,416 9/1990 Wright et al. .
4,956,254 9/1990 Washizu et al. .
4,964,871 10/1990 Reinert et al. .
4,965,294 10/1990 Ohngemach et al. .
4,966,607 10/1990 Shinoki et al. .
4,966,833 10/1990 Inoue .
4,968,596 11/1990 Inoue et al. .
4,968,813 11/1990 Rule et al. .
4,985,345 1/1991 Hayakawa et al. .
4,987,056 1/1991 Imahashi et al. .
4,988,561 1/1991 Wason .
4,997,745 3/1991 Kawamura et al. .
5,001,330 3/1991 Koch .
5,002,853 3/1991 Aoai et al. .

5,002,993 3/1991 West et al. .
5,003,142 3/1991 Fuller .
5,006,758 4/1991 Gellert et al. .
5,013,959 5/1991 Kogelschatz .
5,017,195 5/1991 Satou et al. .
5,023,129 6/1991 Morganti et al. .
5,025,036 6/1991 Carson et al. .
5,026,425 6/1991 Hindagolla et al. .
5,026,427 6/1991 Mitchell et al. .
5,028,262 7/1991 Barlow, Jr. et al. .
5,028,792 7/1991 Mullis .
5,030,243 7/1991 Reinert .
5,030,248 7/1991 Meszaros .
5,034,526 7/1991 Bonham et al. .
5,037,726 8/1991 Kojima et al. .
5,045,435 9/1991 Adams et al. .
5,045,573 9/1991 Kohler et al. .
5,047,556 9/1991 Kohler et al. .
5,049,777 9/1991 Mechtersheimer .
5,053,320 10/1991 Robbillard .
5,055,579 10/1991 Pawlowski et al. .
5,057,562 10/1991 Reinert .
5,068,140 11/1991 Malhotra et al. .
5,068,364 11/1991 Takagaki et al. .
5,069,681 12/1991 Bouwknegt et al. .
5,070,001 12/1991 Stahlhofen .
5,073,448 12/1991 Vieira et al. .
5,074,885 12/1991 Reinert .
5,076,808 12/1991 Hahn et al. .
5,077,402 12/1991 Desobry et al. .
5,085,698 2/1992 Ma et al. .
5,087,550 2/1992 Blum et al. .
5,089,050 2/1992 Vieira et al. .
5,089,374 2/1992 Saeva .
5,096,456 3/1992 Reinert et al. .
5,096,489 3/1992 Laver .
5,096,781 3/1992 Vieira et al. .
5,098,477 3/1992 Vieira et al. .
5,098,793 3/1992 Rohrbach et al. .
5,098,806 3/1992 Robillard .
5,106,723 4/1992 West et al. .
5,108,505 4/1992 Moffat .
5,108,874 4/1992 Griffing et al. .
5,110,706 5/1992 Yumoto et al. .
5,110,709 5/1992 Aoai et al. .
5,114,832 5/1992 Zertani et al. .
5,124,723 6/1992 Laver .
5,130,227 7/1992 Wade et al. .
5,133,803 7/1992 Moffatt .
5,135,940 8/1992 Belander et al. .
5,139,572 8/1992 Kawashima .
5,139,687 8/1992 Borgher, Sr. et al. .
5,141,556 8/1992 Matrick .
5,141,797 8/1992 Wheeler .
5,144,964 9/1992 Demian .
5,147,901 9/1992 Rutsch et al. .
5,153,104 10/1992 Rossman et al. .
5,153,105 10/1992 Sher et al. .
5,153,166 10/1992 Jain et al. .
5,160,346 11/1992 Fuso et al. .
5,160,372 11/1992 Matrick .
5,166,041 11/1992 Murofushi et al. .
5,169,436 12/1992 Matrick .
5,169,438 12/1992 Matrick .
5,173,112 12/1992 Matrick et al. .
5,176,984 1/1993 Hipps, Sr. et al. .
5,178,420 1/1993 Shelby .
5,180,425 1/1993 Matrick et al. .
5,180,624 1/1993 Kojima et al. .
5,180,652 1/1993 Yamaguchi et al. .
5,181,935 1/1993 Reinert et al. .
5,185,236 2/1993 Shiba et al. .
5,187,045 2/1993 Bonham et al. .
5,187,049 2/1993 Sher et al. .
5,190,565 3/1993 Berenbaum et al. .
5,190,710 3/1993 Kletecka .
5,190,845 3/1993 Hashimoto et al. .
5,193,854 3/1993 Borowski, Jr. et al. .
5,196,295 3/1993 Davis .
5,197,991 3/1993 Rembold .
5,198,330 3/1993 Martic et al. .
5,202,209 4/1993 Winnik et al. .
5,202,210 4/1993 Matsuoka et al. .
5,202,211 4/1993 Vercoulen .
5,202,212 4/1993 Shin et al. .
5,202,213 4/1993 Nakahara et al. .
5,202,215 4/1993 Kanakura et al. .
5,202,221 4/1993 Imai et al. .
5,205,861 4/1993 Matrick .
5,208,136 5/1993 Zanoni et al. .
5,209,814 5/1993 Felten et al. .
5,219,703 6/1993 Bugner et al. .
5,221,334 6/1993 Ma et al. .
5,224,197 6/1993 Zanoni et al. .
5,224,857 7/1993 Schultz et al. .
5,224,987 7/1993 Matrick .
5,226,957 7/1993 Wickramanayake et al. .
5,227,022 7/1993 Leonhardt et al. .
5,230,982 7/1993 Davis et al. .
5,241,059 8/1993 Yoshinaga .
5,244,476 9/1993 Schulz et al. .
5,250,109 10/1993 Chan et al. .
5,254,429 10/1993 Gracia et al. .
5,256,193 10/1993 Winnik et al. .
5,258,274 11/1993 Helland et al. .
5,261,953 11/1993 Vieira et al. .
5,262,276 11/1993 Kawamura .
5,268,027 12/1993 Chan et al. .
5,270,078 12/1993 Walker et al. .
5,271,764 12/1993 Winnik et al. .
5,271,765 12/1993 Ma .
5,272,201 12/1993 Ma et al. .
5,275,646 1/1994 Marshall et al. .
5,279,652 1/1994 Kaufmann et al. .
5,282,894 2/1994 Albert et al. .
5,284,734 2/1994 Blum et al. .
5,286,286 2/1994 Winnik et al. .
5,286,288 2/1994 Tobias et al. .
5,294,528 3/1994 Furutachi .
5,296,275 3/1994 Goman et al. .
5,296,556 3/1994 Frihart .
5,298,030 3/1994 Burdeska et al. .
5,300,403 4/1994 Angelopolus et al. .
5,300,654 4/1994 Nakajima et al. .
5,302,195 4/1994 Helbrecht .
5,302,197 4/1994 Wickramanayke et al. .
5,310,778 5/1994 Shor et al. .
5,312,713 5/1994 Yokoyama et al. .
5,312,721 5/1994 Gesign .
5,324,349 6/1994 Sano et al. .
5,328,504 7/1994 Ohnishi .
5,330,860 7/1994 Grot et al. .
5,334,455 8/1994 Noren et al. .
5,338,319 8/1994 Kaschig et al. .
5,340,631 8/1994 Matsuzawa et al. .
5,340,854 8/1994 Martic et al. .
5,344,483 9/1994 Hinton .
5,356,464 10/1994 Hickman et al. .
5,362,592 11/1994 Murofushi et al. .
5,362,916 11/1994 Edwards et al. .
5,368,689 11/1994 Agnemo .
5,372,387 12/1994 Wajda .

| | | |
|---|---|---|
| 5,372,917 | 12/1994 | Tsuchida et al. . |
| 5,374,335 | 12/1994 | Lindgren et al. . |
| 5,376,503 | 12/1994 | Audett et al. . |
| 5,383,961 | 1/1995 | Bauer et al. . |
| 5,384,186 | 1/1995 | Trinh . |
| 5,393,580 | 2/1995 | Ma et al. . |
| 5,401,303 | 3/1995 | Stoffel et al. . |
| 5,401,562 | 3/1995 | Akao . |
| 5,407,969 | 4/1995 | Kleiner et al. . |
| 5,415,686 | 5/1995 | Kurabayashi et al. . |
| 5,415,976 | 5/1995 | Ali . |
| 5,424,407 | 6/1995 | Tanaka et al. . |
| 5,425,978 | 6/1995 | Berneth et al. . |
| 5,426,164 | 6/1995 | Babb et al. . |
| 5,427,415 | 6/1995 | Chang . |
| 5,429,628 | 7/1995 | Trinh et al. . |
| 5,431,720 | 7/1995 | Nagai et al. . |
| 5,432,274 | 7/1995 | Luong et al. . |
| 5,445,651 | 8/1995 | Thoen et al. . |
| 5,445,842 | 8/1995 | Tanaka et al. . |
| 5,455,074 | 10/1995 | Nohr et al. . |
| 5,455,143 | 10/1995 | Ali . |
| 5,459,014 | 10/1995 | Nishijima et al. . |
| 5,464,472 | 11/1995 | Horn et al. . |
| 5,466,283 | 11/1995 | Kondo et al. . |
| 5,474,691 | 12/1995 | Severns . |
| 5,475,080 | 12/1995 | Gruber et al. . |
| 5,476,540 | 12/1995 | Shields et al. . |
| 5,479,949 | 1/1996 | Battard et al. . |
| 5,489,503 | 2/1996 | Toan . |
| 5,498,345 | 3/1996 | Jollenbeck et al. . |
| 5,501,774 | 3/1996 | Burke . |
| 5,501,902 | 3/1996 | Kronzer . |
| 5,503,664 | 4/1996 | Sano et al. . |
| 5,509,957 | 4/1996 | Toan et al. . |
| 5,531,821 | 7/1996 | Wu . |
| 5,532,112 | 7/1996 | Kohler et al. . |
| 5,541,633 | 7/1996 | Winnik et al. . |
| 5,543,459 | 8/1996 | Hartmann et al. . |
| 5,569,529 | 10/1996 | Becker et al. . |
| 5,571,313 | 11/1996 | Mafune et al. . |
| 5,575,891 | 11/1996 | Trokhan et al. . |
| 5,580,369 | 12/1996 | Belding et al. . |
| 5,591,489 | 1/1997 | Dragner et al. . |
| 5,597,405 | 1/1997 | Grigoryan et al. . |
| 5,607,803 | 3/1997 | Murofushi et al. . |
| 5,616,443 | 4/1997 | Nohr et al. . |
| 5,635,297 | 6/1997 | Ogawa et al. . |
| 5,643,356 | 7/1997 | Nohr et al. . |
| 5,643,631 | 7/1997 | Donigian et al. . |
| 5,643,701 | 7/1997 | Nohr et al. . |
| 5,645,964 | 7/1997 | Nohr et al. . |
| 5,672,392 | 9/1997 | De Clercq et al. . |
| 5,681,380 | 10/1997 | Nohr et al. . |
| 5,683,843 | 11/1997 | Nohr et al. . |
| 5,685,754 | 11/1997 | Nohr et al. . |
| 5,686,503 | 11/1997 | Nohr et al. . |
| 5,700,582 | 12/1997 | Sargeant et al. . |
| 5,700,850 | 12/1997 | Nohr et al. . |
| 5,705,247 | 1/1998 | Arai et al. . |
| 5,709,955 | 1/1998 | Nohr et al. . |
| 5,709,976 | 1/1998 | Malhotra . |
| 5,721,287 | 2/1998 | Nohr et al. . |
| 5,733,693 | 3/1998 | Nohr et al. . |
| 5,738,932 | 4/1998 | Kondo et al. . |
| 5,739,175 | 4/1998 | Nohr et al. . |
| 5,747,550 | 5/1998 | Nohr et al. . |
| 5,773,182 | 6/1998 | Nohr et al. . |
| 5,782,963 | 7/1998 | Nohr et al. . |
| 5,786,132 | 7/1998 | Nohr et al. . |
| 5,798,015 | 8/1998 | Nohr et al. . |
| 5,811,199 | 9/1998 | MacDonald et al. . |
| 5,837,429 | 11/1998 | Nohr et al. . |
| 5,849,411 | 12/1998 | Nohr et al. . |
| 5,855,655 | 1/1999 | Nohr et al. . |
| 5,856,515 | 1/1999 | Therien et al. . |
| 5,865,471 | 2/1999 | Nohr et al. . |
| 5,883,161 | 3/1999 | Wood et al. . |
| 5,885,337 | 3/1999 | Nohr et al. . |
| 5,891,229 | 4/1999 | Nohr et al. . |
| 5,911,855 | 6/1999 | Dransmann et al. . |
| 6,022,906 | 2/2000 | Ohwa et al. . |
| 6,092,890 * | 7/2000 | Wen et al. ..... 347/101 |

FOREIGN PATENT DOCUMENTS

| | | |
|---|---|---|
| 637169 | 3/1964 | (BE) . |
| 413257 | 10/1932 | (CA) . |
| 458808 | 12/1936 | (CA) . |
| 460268 | 10/1949 | (CA) . |
| 461082 | 11/1949 | (CA) . |
| 463021 | 2/1950 | (CA) . |
| 463022 | 2/1950 | (CA) . |
| 465495 | 5/1950 | (CA) . |
| 465496 | 5/1950 | (CA) . |
| 465499 | 5/1950 | (CA) . |
| 483214 | 5/1952 | (CA) . |
| 517364 | 10/1955 | (CA) . |
| 537687 | 3/1957 | (CA) . |
| 552565 | 2/1958 | (CA) . |
| 571792 | 3/1959 | (CA) . |
| 779239 | 2/1968 | (CA) . |
| 930103 | 7/1973 | (CA) . |
| 2053094 | 4/1992 | (CA) . |
| 603767 | 8/1978 | (CH) . |
| 197808 | 5/1988 | (CH) . |
| 94118 | 5/1958 | (CS) . |
| 1047787 | 12/1957 | (DE) . |
| 1022801 | 1/1958 | (DE) . |
| 1039835 | 9/1958 | (DE) . |
| 1040562 | 10/1958 | (DE) . |
| 1045414 | 12/1958 | (DE) . |
| 1047013 | 12/1958 | (DE) . |
| 1132540 | 7/1962 | (DE) . |
| 1154069 | 9/1963 | (DE) . |
| 1240811 | 5/1967 | (DE) . |
| 2202497 | 8/1972 | (DE) . |
| 2432563 | 2/1975 | (DE) . |
| 2437380 | 2/1975 | (DE) . |
| 2444520 | 3/1975 | (DE) . |
| 2416259 | 10/1975 | (DE) . |
| 2714978 | 10/1977 | (DE) . |
| 2722264 | 11/1978 | (DE) . |
| 158237 | 1/1983 | (DE) . |
| 3126433 | 1/1983 | (DE) . |
| 3415033 | 10/1984 | (DE) . |
| 271512 | 9/1989 | (DE) . |
| 3921600 | 1/1990 | (DE) . |
| 3833437 | 4/1990 | (DE) . |
| 3833438 | 4/1990 | (DE) . |
| 004036328 | 7/1991 | (DE) . |
| 4132288 | 4/1992 | (DE) . |
| 4126461 | 2/1993 | (DE) . |
| 0003884 | 9/1979 | (EP) . |
| 0029284 | 5/1981 | (EP) . |
| 0127574 | 12/1984 | (EP) . |
| 0202803 | 11/1986 | (EP) . |
| 0 209 831 | 1/1987 | (EP) . |
| 0223587 | 5/1987 | (EP) . |
| 0262533 | 4/1988 | (EP) . |
| 0280458 | 8/1988 | (EP) . |
| 0 303 803 | 2/1989 | (EP) . |
| 0308274 | 3/1989 | (EP) . |

| | | | | |
|---|---|---|---|---|
| 0351615 | | 1/1990 | (EP) . | |
| 0371304 | | 6/1990 | (EP) . | |
| 0373662 | | 6/1990 | (EP) . | |
| 0375160 | | 6/1990 | (EP) . | |
| 0390439 | | 10/1990 | (EP) . | |
| 0433201 | | 6/1991 | (EP) . | |
| 0458140A1 | | 10/1991 | (EP) . | |
| 0458140 | | 11/1991 | (EP) . | |
| 0468465 | | 1/1992 | (EP) . | |
| 0 469 595 | | 2/1992 | (EP) . | |
| 0 475 075 | | 3/1992 | (EP) . | |
| 0542286 | | 5/1993 | (EP) . | |
| 000571190 | | 11/1993 | (EP) . | |
| 0 605 840 | | 7/1994 | (EP) . | |
| 0608433 | | 8/1994 | (EP) . | |
| 0609159 | | 8/1994 | (EP) . | |
| 0 635 380 | | 1/1995 | (EP) . | |
| 0639664 | | 2/1995 | (EP) . | |
| 0658607 | | 6/1995 | (EP) . | |
| 0 673 779 | | 9/1995 | (EP) . | |
| 0694594 | | 1/1996 | (EP) . | |
| 0 716 929 | | 6/1996 | (EP) . | |
| 0 737 592 | | 10/1996 | (EP) . | |
| 0755984 | | 1/1997 | (EP) . | |
| 0 805 152 | | 11/1997 | (EP) . | |
| 0 861 880 | | 9/1998 | (EP) . | |
| 0878482 | | 11/1998 | (EP) . | |
| 0878482 A1 | * | 11/1998 | (EP) | C08F/2/48 |
| 2245010 | | 4/1975 | (FR) . | |
| 2383157 | | 10/1978 | (FR) . | |
| 275245 | | 10/1928 | (GB) . | |
| 349339 | | 5/1931 | (GB) . | |
| 355686 | | 8/1931 | (GB) . | |
| 399753 | | 10/1933 | (GB) . | |
| 441085 | | 1/1936 | (GB) . | |
| 463515 | | 4/1937 | (GB) . | |
| 492711 | | 9/1938 | (GB) . | |
| 518612 | | 3/1940 | (GB) . | |
| 539912 | | 9/1941 | (GB) . | |
| 626727 | | 7/1947 | (GB) . | |
| 600451 | | 4/1948 | (GB) . | |
| 616362 | | 1/1949 | (GB) . | |
| 618616 | | 2/1949 | (GB) . | |
| 779389 | | 7/1957 | (GB) . | |
| 1150987 | | 5/1969 | (GB) . | |
| 1372884 | | 11/1974 | (GB) . | |
| 2146357 | | 4/1985 | (GB) . | |
| 662500 | | 4/1964 | (IT) . | |
| 4315663 | | 7/1968 | (JP) . | |
| 4726653 | | 7/1972 | (JP) . | |
| 4745409 | | 11/1972 | (JP) . | |
| 49-8909 | | 2/1974 | (JP) . | |
| 5065592 | | 6/1975 | (JP) . | |
| 51-17802 | | 2/1976 | (JP) . | |
| 53-104321 | | 9/1978 | (JP) . | |
| 55-62059 | | 5/1980 | (JP) . | |
| 55-90506 | | 7/1980 | (JP) . | |
| 56-8134 | | 1/1981 | (JP) . | |
| 0014233 | | 2/1981 | (JP) . | |
| 5614569 | | 2/1981 | (JP) . | |
| 56-24472 | | 3/1981 | (JP) . | |
| 56-36556 | | 4/1981 | (JP) . | |
| 5761055 | | 4/1982 | (JP) . | |
| 57128283 | | 8/1982 | (JP) . | |
| 57171775 | | 10/1982 | (JP) . | |
| 58-124452 | | 7/1983 | (JP) . | |
| 58-125770 | | 7/1983 | (JP) . | |
| 58-222164 | | 12/1983 | (JP) . | |
| 5989360 | | 5/1984 | (JP) . | |
| 29219270 | | 12/1984 | (JP) . | |
| 59-219270 | | 4/1985 | (JP) . | |
| 60-192729 | | 10/1985 | (JP) . | |
| 60239739 | | 11/1985 | (JP) . | |
| 60239740 | | 11/1985 | (JP) . | |
| 60239741 | | 11/1985 | (JP) . | |
| 60239743 | | 11/1985 | (JP) . | |
| 61-14994 | | 1/1986 | (JP) . | |
| 61-14995 | | 1/1986 | (JP) . | |
| 61-21184 | | 1/1986 | (JP) . | |
| 61-288 | | 1/1986 | (JP) . | |
| 613781 | | 1/1986 | (JP) . | |
| 61-25885 | | 2/1986 | (JP) . | |
| 61-30592 | | 2/1986 | (JP) . | |
| 61-40366 | | 2/1986 | (JP) . | |
| 61-77846 | | 4/1986 | (JP) . | |
| 61-128973 | | 6/1986 | (JP) . | |
| 61-97025 | | 9/1986 | (JP) . | |
| 61-222789 | | 10/1986 | (JP) . | |
| 61-247703 | | 11/1986 | (JP) . | |
| 61-285403 | | 12/1986 | (JP) . | |
| 627703 | | 1/1987 | (JP) . | |
| 62-100557 | | 5/1987 | (JP) . | |
| 62-97881 | | 5/1987 | (JP) . | |
| 62127281 | | 6/1987 | (JP) . | |
| 63-43959 | | 2/1988 | (JP) . | |
| 63-48370 | | 3/1988 | (JP) . | |
| 6395439 | | 4/1988 | (JP) . | |
| 6395440 | | 4/1988 | (JP) . | |
| 6395445 | | 4/1988 | (JP) . | |
| 6395446 | | 4/1988 | (JP) . | |
| 6395447 | | 4/1988 | (JP) . | |
| 6395448 | | 4/1988 | (JP) . | |
| 6395449 | | 4/1988 | (JP) . | |
| 6395450 | | 4/1988 | (JP) . | |
| 63151946 | | 6/1988 | (JP) . | |
| 63-164953 | | 7/1988 | (JP) . | |
| 63-165498 | | 7/1988 | (JP) . | |
| 63-223077 | | 9/1988 | (JP) . | |
| 63-223078 | | 9/1988 | (JP) . | |
| 63-243101 | | 10/1988 | (JP) . | |
| 63-199781 | | 12/1988 | (JP) . | |
| 64-15049 | | 1/1989 | (JP) . | |
| 6429337 | | 1/1989 | (JP) . | |
| 64-40948 | | 2/1989 | (JP) . | |
| 89014948 | | 3/1989 | (JP) . | |
| 1-128063 | | 5/1989 | (JP) . | |
| 1146974 | | 6/1989 | (JP) . | |
| 01210477 | | 8/1989 | (JP) . | |
| 1288854 | | 11/1989 | (JP) . | |
| 2-58573 | | 2/1990 | (JP) . | |
| 292957 | | 4/1990 | (JP) . | |
| 2179642 | | 7/1990 | (JP) . | |
| 2282261 | | 11/1990 | (JP) . | |
| 3-134072 | | 6/1991 | (JP) . | |
| 03163566 | | 7/1991 | (JP) . | |
| 3-170415 | | 7/1991 | (JP) . | |
| 3-206439 | | 9/1991 | (JP) . | |
| 3-258867 | | 11/1991 | (JP) . | |
| 3-203694 | | 12/1991 | (JP) . | |
| 3284668 | | 12/1991 | (JP) . | |
| 03295653 A | * | 12/1991 | (JP) | B41J/2/01 |
| 4023884 | | 1/1992 | (JP) . | |
| 4023885 | | 1/1992 | (JP) . | |
| 424756 | | 1/1992 | (JP) . | |
| 4-45174 | | 2/1992 | (JP) . | |
| 4100801 | | 4/1992 | (JP) . | |
| 4-136075 | | 5/1992 | (JP) . | |
| 04356087 | | 12/1992 | (JP) . | |
| 543806 | | 2/1993 | (JP) . | |
| 561220 | | 3/1993 | (JP) . | |
| 5080506 | | 4/1993 | (JP) . | |
| 05119506 | | 5/1993 | (JP) . | |

| | | | |
|---|---|---|---|
| 5134447 | 5/1993 | (JP) . | |
| 5-140498 | 6/1993 | (JP) . | |
| 2-219869 | 9/1993 | (JP) . | |
| 5263067 | 10/1993 | (JP) . | |
| 680915 | 3/1994 | (JP) . | |
| 6116555 | 4/1994 | (JP) . | |
| 6116556 | 4/1994 | (JP) . | |
| 6116557 | 4/1994 | (JP) . | |
| 6-175584 | 6/1994 | (JP) . | |
| 6214339 | 8/1994 | (JP) . | |
| 6256494 | 9/1994 | (JP) . | |
| 6256633 | 9/1994 | (JP) . | |
| 08060051 A * | 3/1996 | (JP) | B41J/2/01 |
| 7113828 | 4/1972 | (NL) . | |
| 1310767 | 5/1987 | (RU) . | |
| 1772118 | 10/1992 | (SU) . | |
| 92/11295 | 7/1992 | (WO) . | |
| 93/06597 | 4/1993 | (WO) . | |
| 94/01503 | 1/1994 | (WO) . | |
| 94/22500 | 10/1994 | (WO) . | |
| 94/22501 | 10/1994 | (WO) . | |
| 95/04955 | 2/1995 | (WO) . | |
| 95/28285 | 10/1995 | (WO) . | |
| 96/00740 | 1/1996 | (WO) . | |
| 96/19502 | 6/1996 | (WO) . | |
| 96/22335 | 7/1996 | (WO) . | |
| 96/24636 | 8/1996 | (WO) . | |
| 97/20000 | 6/1997 | (WO) . | |
| 97/35933 | 10/1997 | (WO) . | |
| 98/23695 | 6/1998 | (WO) . | |
| 99/36476 | 7/1999 | (WO) . | |

OTHER PUBLICATIONS

ESP@CENET databse JP 10324836 (Omron Corp.), Dec. 8, 1998. abstract .

Wang et al. Effects of substituenta attached at benzaldehyde on the synthesis and properties of porphyrins *Chem. Abstracts* 113(9), 1996.

Derwent World Patents Index JP 8002092 (Mitsubishi Paper Mills Ltd.) Jan. 9, 1996. abstract.

Kubat et al. "Photophysical properties of metal complexes of meso–tetrakis (40sulphonatophenyl) porphyrin," *J. Photochem. and Photobiol.* 96 93–97, 1996.

Derwent World Patents Index EP 659039 (Canon KK) Jun. 21, 1995. abstract, 1995.

Derwent World Patents Index JP 7061114 (Dainippon Printing Co. Ltd.) Mar. 7, 1995. abstract.

Abstract for WO 95/00343—A1 *Textiles: Paper: Cellulose* p. 7, 1995.

Maki, Y. et al. "A novel heterocyclic N–oxide, pyrimido[5, 4–g]pteridinetetrone 5–oxide, with multifunctional photo-oxidative properties" *Chemical Abstracts,* 122 925 [No. 122:31350F], 1995.

Patent Abstracts of Japan JP 06200204 (Brother Ind Ltd), Jul. 19, 1994.

Abstract of patent, JP 6–80915 (Canon Inc.), Mar. 22, 1994.

Abstract of patent, JP 06–43573 (Iku Meji) (Feb. 18, 1994).

Pitchumani, K. et al. "Modification of chemical reactivity upon cyclodextrin encapsulation" *Chemical Abstracts* 121 982 [No. 121:133624v], 1994.

Wijesekera, T.P., et al. Synthetic Aspects of Pophyrin and Metalloporphyrin Chemistry *Metalloporpyrins in Catalytic Oxidations* pp. 202–203, 206–207, 1994.

Derwent Publications Ltd., London, JP 05297627 (Fujitsu Ltd.), Nov. 12, 1993. (Abstract).

Patent Abstracts of Japan, JP 5241369 (Bando Chem Ind Ltd et al.), Sep. 21, 1993. (Abstract).

Derwent Publications Ltd., London, JP 05232738 (Yamazaki, T.), Sep. 10, 1993. (Abstract).

Derwent Publications Ltd., London, EP 000559310 (Zeneca Ltd.), Sep. 8, 1993. (Abstract).

Derwent Publications Ltd., London, J,A, 5–230410 (Seiko Epson Corp), Sep. 7, 1993. (Abstract).

Derwent Publications Ltd., London, JP 5–230407 (Mitsubishi Kasei Corp), Sep. 7, 1993. (Abstract).

Abstract Of Patent, JP 405230410 (Seiko Epson Corp.), Sep. 7, 1993. (Abstract).

Abstract of Patent, JP 405230407 (Mitsubishi Kasei Corp.), Sep. 7, 1993. (Abstract).

Patent Abstracts of Japan, JP 5197198 (Bando Chem Ind Ltd et al.), Aug. 6, 1993. (Abstract).

Database WPI—Derwent Publications Ltd., London, J,A, 5197069 (Bando Chem), Aug. 6, 1993. (Abstract).

Abstract of patent, JP 5–195450 (Nitto Boseki Co. Ltd), Aug. 3, 1993.

Derwent World Patents Index JP 5186725 (Seiko Epson Corp.), Jul. 27, 1993. abstract.

Patent Abstracts of Japan, JP 5181308 (Bando Chem Ind Ltd et al.), Jul. 23, 1993. (Abstract).

Patent Abstracts of Japan, JP 5181310 (Bando Chem Ind Ltd et al.), Jul. 23, 1993. (Abstract).

Derwent Publications Ltd., London, JP 5–132638 (Mitsubishi Kasei Corp), May 28, 1993. (Abstract).

Abstract Of Patent, JP 405132638 (Mitsubishi Kasei Corp.), May 28, 1993. (Abstract).

Derwent Publications Ltd., London, JP 5–125318 (Mitsubishi Kasei Corp), May 21, 1993. (Abstract).

Abstract Of Patent, JP 405125318 (Mitsubishi Kasei Corp.), May 21, 1993. (Abstract).

Abstract of patent, JP 05–117200 (Hidefumi Hirai et al.) (May 14, 1993).

Derwent World Patents Index, JP 5117105 (Mitsui Toatsu Chem Inc.) May 14, 1993.

Derwent Publications Ltd., London, JP 05061246 (Ricoh KK), Mar. 12, 1993. (Abstract).

Husain, N. et al. "Cyclodextrins as mobile–phase additives in reversed–phase HPLC" *American Laboratory* 82 80–87, 1993.

Hamilton, D.P. "Tired of Shredding? New Ricoh Method Tries Different Tack" *Wall Street Journal* B2, 1993.

"Cyclodextrins: A Breakthrough for Molecular Encapsulation" American Maize Products Co. (AMAIZO), 1993.

Duxbury "The Photochemistry and Photophysics of Triphenylmethane Dyes in Solid Liquid Media" *Chemical Review* 93 381–433, 1993.

Abstract of patent, JP 04–351603 (Dec. 7, 1992).

Abstract of patent, JP 04–351602, 1992.

Derwent Publications Ltd., London, JP 404314769 (Citizen Watch Co. Ltd.), Nov. 5, 1992. (Abstract).

Abstract of patent, JP 04315739, 1992.

Derwent Publications Ltd., London, JP 04300395 (Funai Denki KK), Oct. 23, 1992. (Abstract).

Derwent Publications Ltd., London, JP 404213374 (Mitsubishi Kasei Corp), Aug. 4, 1992. (Abstract).

Abstract of patent, JP 04–210228, 1992.

Abstract Of Patent, JP 404202571 (Canon Inc.), Jul. 23, 1992. (Abstract).

Abstract Of Patent, JP 404202271 (Mitsubishi Kasei Corp.), Jul. 23, 1992. (Abstract).

Derwent WPI, JP 4–197657 (Toshiba KK) Jul. 17, 1992, abstract.

Derwent Publications Ltd., London, JP 4–189877 (Seiko Epson Corp), Jul. 8, 1992. (Abstract).
Derwent Publications Ltd., London, JP 404189876 (Seiko Epson Corp), Jul. 8, 1992. (Abstract).
Abstract of Patent, JP 404189877 (Seiko Epson Corp.), Jul. 8, 1992. (Abstract).
Derwent Publications Ltd., London, J,A, 4–170479 (Seiko Epson Corp), Jun. 18, 1992. (Abstract).
Abstract of patent, JP 04–81402, 1992.
Abstract of patent, JP 04–81401, 1992.
Kogelschatz "Silent–discharge driven excimer UV sources and their applications" *Applied Surface Science* 410–423, 1992.
Patent Abstracts of Japan JP 03295653 (Matsushita Electric Works Ltd.), Dec. 26, 1991.
Derwent Publications Ltd., London, JP 403269167 (Japan Wool Textile KK), Nov. 29, 1991 (Abstract).
Derwent Publications Ltd., London, JO 3247676 (Canon KK), Nov. 5, 1991 (Abstract).
Tand, F. Synthesis and Properties of 5, 10, 15, 20–tetrakis (4–=methoxyl–3–sulfophenyl) porphine *Chem Abstracts* 115(17), 1991.
Abstract of patent, JP 03–220384, 1991.
Patent Abstracts of Japan, JP 03184896 (Dainippon Printing Co Ltd.) Aug. 12, 1991.
Derwent Publications Ltd., London, JP 3167270 (Mitsubishi Kasei Corp), Jul. 19, 1991. (Abstract).
Derwent Publications Ltd., London, JO 3167270 (Mitsubishi Kasei Corp.), Jul. 19, 1991 (Abstract).
Derwent World Patents Index EP 435536 (Canon KK) Jul. 3, 1991. abstract.
Derwent Publications Ltd., London, JO 3093870 (Dainippon Ink Chem KK.), Apr. 18, 1991 (Abstract).
Abstract of patent, JP 06369890, 1991.
Kogelschatz, U. et al. "New Excimer UV Sources for Industrial Applications" *ABB Review* 391 1–10, 1991.
Abstract of patent, JP 03–41165, 1991.
"Coloring/Decoloring Agent for Tonor Use Developed" *Japan Chemical Week,* 1991.
Braithwaite, M., et al. "Formulation" *Chemistry & Technology of UV & EB Formulation for Coatings, Inks & Paints* IV 11–12, 1991.
Scientific Polymer Products, Inc. Brochure 24–31, 1991.
Dietliker, K. "Photoiniators for Free Radical and Catioinc Polymerisation" *Chem & Tech of UV & EB Formulation for Coatings, Inks & Paints* III 61, 63, 229–232, 280, 405, 1991.
Esrom et al. "Large area Photochemical Dry Etching of Polymers iwth Incoherent Excimer UV Radiation" MRS Materials Research Society 1–7, 1991.
Esrom et al. Excimer Laser–Induced Decomposition of Aluminum Nitride Materials Research Society Fall Meeting 1–6, 1991.
Esrom et al. "Metal deposition with a windowless VUV excimer source" *Applied Surface Science* 1–5, 1991.
Esrom "Excimer Laser–Induced Surface Activation of Aln for Electroless Metal Deposition" *Mat. Res. Sco.1Symp. Proc.* 204 457–465, 1991.
Zhang et al. "UV–induced decompositin of adsorbed Cu–acetylacetonate films at room temperature for electroless metal plating" *Applied Surface Science* 1–6, 1991.
"German company develops reusable paper" *Pulp & Paper,* 1991.
Abstract of patent, JP 02289652, 1990.
Ohashi et al. "Molecular Mechanics Studies on Inclusion Compounds of Cyanine Dye Monomers and Dimers in Cyclodextrin Cavities," *J. Am. Chem. Soc.* 112 5824–5830, 1990.
Kogelschatz et al. "New Incoherent Ultraviolet Excimer Sources for Photolytic Material Deposition," *Laser Und Optoelectronik,* 1990.
Patent Abstracts of Japan, JP 02141287 (Dainippon Printing Co Ltd.) May 30, 1990.
Abstract of Patent, JP 0297957, (Fuji Xerox Co., Ltd.), 1990.
Derwent Publications Ltd., London, JP 2091166 (Canon, KK), Mar. 30, 1990. (Abstract).
Zhang, Zhoupeng Synthesis of 7 meso–tetrasubstituted porphyrins *Chem. Abstracts* 113(9), 1990.
Esrom et al. "Metal Deposition with Incoherent Excimer Radiation" *Mat. Res. Soc. Symp. Proc.* 158 189–198, 1990.
Estrom "UV Excimer Laser–Induced Deposition of Palladium from palladiym Acetate Films" *Mat. Res. Soc. Symp. Proc.* 158 109–117, 1990.
Kogelschatz, U. "Silent Discharges for the Generation of ultraviolet and vacuum ultraviolet excimer radiation" *Pure & Applied Chem.* 62 1667–74, 1990.
Esrom et al. "Investigation of the mechanism of the UV–induced palladium depostions processf from thin solid palladium acetate films" *Applied Surface Science* 46 158–162, 1990.
Zhang et al. "VUV synchrotron radiation processing of thin palladium acetate spin–on films for metallic surface patterning" *Applied Surface Science* 46 153–157, 1990.
Brennan et al. "Stereoelectronic effects in ring closure reactions: the 2'–hydroxychalcone—flavanone equilibrium, and related systems," *Canadian J. Chem.* 68(10) pp. 1780–1785, 1990.
Abstract of patent, JP 01–299083, 1989.
Derwent Publications Ltd., London, J,O, 1182379 (Canon KK), Jul. 20, 1989. (Abstract).
Derwent Publications Ltd., London, JO 1011171 (Mitsubishi Chem Ind. KK.), Jan. 13, 1989 (Abstract).
Gruber, R.J. et al. "Xerographic Materials" *Encyclopedia of Polymer Science and Engineering* 17 918–943, 1989.
Pappas, S.P. "Photocrosslinking" *Comph. Pol. Sci.* 6 135–148, 1989.
Pappas, S.P. "Photoinitiated Polymerization" *Comph. Pol. Sci.* 4 337–355, 1989.
Kirilenko, G.V. et al. "An analog of the vesicular process with amplitude modulation of the incident light beam" *Chemical Abstracts* 111 569 [No. 111:123633b], 1989.
Esrom et al. "UV excimer laser–induced pre–nucleation of surfaces followed by electroless metallization" *Chemtronics* 4 216–223, 1989.
Esrom et al. "VUV light–induced depostion of palladium using an incoherent Xe2* excimer source" *Chemtronics* 4, 1989.
Esrom et al. "UV Light–Induced Deposition of Copper Films" C–719–C5–725, 1989.
Falbe et al. *Rompp Chemie Lexikon* 9 270 1989.
Allen, Norman S. *Photopolymerisation and Photoimaging Science and Technology* pp. 188–199; 210–239, 1989.
Lindsey, J.S. et al. Investigation of the Synthesis of Ortho–Substituted Tetraphenylporphyrins *J. Org. Chem.* 54 pp. 828–836, 1989.
Patent Abstracts of Japan, JP 63297477 (Fuji Photo Film Co. Ltd.) Dec. 5, 1988, abstract.

Derwent Publications, Ltd., London, SU 1423656 (Kherson Ind Inst), Sep. 15, 1988 (Abstract).
Derwent Publications, Ltd., London, EP 0280653 (Ciba GeigyAG), Aug. 31, 1988 (Abstract).
Abstract of patent, JP 63–190815, 1988.
Patent Abstracts of Japan, JP 63179985 (Tomoegawa Paper Co. Ltd.), Jul. 23, 1988.
Derwent World Patents Index, JP 63179977 (Tomoegawa Paper Mfg Co Ltd), Jul. 23, 1988.
Furcone, S.Y. et al. "Spin–on B14SrCa3Cu4O16+x superconducting thin films from citrate precursors," *Appl. Phys. Lett.* 52(25) 2180–2182, 1988.
Abstract of patent, JP 63–144329, 1988.
Abstract of patent, JP 63–130164, 1988.
Derwent Publications, Ltd., London, J6 3112770 (Toray Ind Inc), May 17, 1988 (Abstract).
Derwent Publications, Ltd., London, J6 3108074 (Konishiroku Photo KK), May 12, 1988 (Abstract).
Derwent Publications, Ltd., London,J6 3108073 (Konishiroku Photo KK), May 12, 1988 (Abstract).
Abstract of Patent, JP 61–77846, 1988.
Abstract of Patent, JP 63–73241, 1988.
Patent Abstracts of Japan JP 63062738 (Seiko Epson Corp), Mar. 19, 1988.
Abstract of Patent, JP 63–47762, 1988.
Abstract of Patent, JP 63–47763, 1988.
Abstract of Patent, JP 63–47764, 1988.
Abstract of Patent, JP 63–47765, 1988.
Eliasson, B., et al. "UV Excimer Radiation from Dielectric–Barrier Discharges" *Applied Physics B* 46 299–303, 1988.
Eliasson, et al. "New Trends in High Intensity UV Generation" *EPA Newsletter* (32) 29–40, 1988.
Cotton, F.A. "Oxygen: Group Via(16)" *Advanced Inorganic Chemistry* 5th ed. 473–474, 1988.
Derwent Publications, Ltd., London, J6 2270665 (Konishiroku Photo KK), Nov. 25, 1987 (Abstract).
Abstract of Patent, JP 62–215261, 1987.
Derwent World Patents Index JP 62064874 (Dainichiseika Color & Chem Mfg.), Mar. 23, 1987. abstract.
Derwent World Patents Index JP 62064874 (Dainichiseika Color & Chem. Mfg.), Mar. 23, 1987, abstract.
Database WPI, Derwent Publications Ltd., London, JP 62032082 (Mitsubishi Denki KK), Feb. 12, 1987 (Abstract).
Abstract of patent, JP 62–32082, 1987.
Derwent Publications Ltd., London, J6 2007772 (Alps Electric KK.), Jan. 14, 1987 (Abstract).
Gross et al. "Laser direct–write metallization in thin palladium acetate films" *J. App. Phys.* 61(4) 1628–1632, 1987.
Al–Ismail et al. "Some experimental results on thin polypropylene films loaded with finely–dispersed copper" *Journal of Materials Science* 415–418, 1987.
Baufay et al. "Optical self–regulation during laser–induced oxidation of copper" *J. Appl. Phys* 61(9) 4640–4651, 1987.
Lindsey, J.S. et al. Rothemund and Adler–Longo Reactions Revisited: Synthesis of Tetraphenylporphyrins under Equilibrium Conditions *J. Org. Chem.* 52 pp. 827–836, 1987.
Derwent Publications, Ltd., London, JA 0284478 (Sanyo Chem Ind Ltd.), Dec. 15, 1986 (Abstract).
Abstract of patent, JP 61251842, 1986.
Database WPI, Derwent Publications Ltd., London, GB: SU, A, 1098210 (Kutulya L A) Jun. 23, 1986.
Abstract of patent, JP 61–97025, 1986.
Abstract of patent, JP 61–87760, 1986.
Derwent Publications Ltd., London, DL 0234731 (Karl Marx Univ. Leipzig), Apr. 9, 1986. (Abstract).
Derwent World Patent Index, SU 1219612 (AS USSR NON–AQ SOLN) Mar. 23, 1986.
Derwent Publications, Ltd., London, J6 1041381 (Osaka Prefecture), Feb. 27, 1986 (Abstract).
Dialog, JAPIO, JP 61–034057 (Ciba Geigy AG) Feb. 18, 1986.
Derwent World Patents Index, JP 61027288 (sumitomo Chem Ind KK) Feb. 6, 1986.
Sakai et al. "A Novel and Practical Synthetic Method of 3(2H)–Furanone Derivatives," *J. Heterocyclie Chem.* 23 pp. 1199–1201, 1986.
Jellinek, H.H.G. et al. "Evolution of H2O and CO2 During the Copper–Catalyzed Oxidation of Isotactic Polypropylene," *J. Polymer Sci.* 24 389–403, 1986.
Jellinek, H.H.G. et al. "Diffusion of Ca2+ Catalysts from Cu–Metal Polymer or Cu–Oxide/Polymer Interfaces into Isotactic Polypropylene," *J. Polymer Sci.* 24 503–510, 1986.
John J. Eisch and Ramiro Sanchez "Selective, Oxophilic Imination of Ketones with Bis (dichloroaluminum) Phenylimide" *J. Org. Chem.* 51(10) 1848–1852, 1986.
Derwent Publications Ltd., London, J6 0226575 (Sumitomo Chem Ind Ltd.), Oct. 11, 1985 (Abstract).
Abstract of patent, JP 60–156761, 1985.
Derwent World Patents Index DE 3443565 (Mitsubishi Yuka Fine Che. et al.) Jul. 11, 1985. abstract.
Derwent Publications Ltd., London, J,A, 0011451 (Fugi Photo Film KK), Jan. 21, 1985. (Abstract).
Derwent Publications, Ltd., London J6 001449—A (Taoka Chemical KK) Jan. 21, 1985 (abstract).
Derwent World Patents Index JP 60–008088 (Mitsubishi Paper Mills Ltd.) Jan. 16, 1985. Patents Index JP 60–008088 (Mitsubishi Paper Mills Ltd.) Jan. 16, 1985. abstract.
Roos, G. et al. "Textile applications of photocrosslinkable polymers" *Chemical Abstracts* 103 57 [No. 103:23690j], 1985.
Beck, M.T., et al. Mechanism of the autophotosensitized formulation of porphyrins in the reaction of pyrrole and m–disulfonated *Chemical Abstracts* 198 5:45 362, 1985.
Derwent World Patents Index, EP 127574 (Ciba Geigy AG), Dec. 5, 1984.
Derwent Publications Ltd., London, JP 0198187 (Canon KK), Nov. 9, 1984. (Abstract).
Derwent Publications Ltd., London, J,A, 0169883 (Ricoh KK), Sep. 25, 1984. (Abstract).
Derwent Publications Ltd., London, JA 0198187 (Canon KK), Nov. 9, 1984 (Abstract).
Derwent Publications Ltd., London, J,A, 0053563 (Dainippon Toryo KK), Mar. 28, 1984. (Abstract).
Derwent Publications Ltd., London, J,A, 0053562 (Dainippon Toryo KK), Mar. 28, 1984. (Abstract).
Abstract of Patent, JA 0053563 (Dainippon Toryo KK), Mar. 28, 1984 (Abstract).
Derwent Publications Ltd., London, J,A, 0051961 (Dainippon Toryo KK), Mar. 26, 1984). (Abstract).
Abstract of Patent, JA 0051961 (Dainippon Toryo KK), Mar. 26, 1984 (Abstract).
Saenger, W. "Structural Aspects of Cyclodextrins and Their Inclusion Complexes" *Inclusion Compounds—Structural Aspects of Inclusion Compounds formed by Organic Host* 2 231–259, 1984.
Szejtli "Industrial Applications of Cyclodextrins" *Inclusion Compounds: Physical Prop. & Applns* 3 331–390, 1984.

Kano et al. "Three–Component Complexes of Cyclodextrins. Exciplex Formation in Cyclodextrin Cavity," *J. Inclusion Phenomena 2* pp. 737–746, 1984.
Suzuki et al. "Spectroscopic Investigation of Cyclodextrin Monomers, Derivatives, Polymers and Azo Dyes," *J. Inclusion Phenomena 2,* pp. 715–724, 1984.
Abstract of Patent, JA 0222164 (Ricoh KK), Dec. 23, 1983 (Abstract).
Abstract of Patent, JP 58211426 (Sekisui Plastics KK), (Dec. 8, 1983).
Derwent Publications, Ltd., London, EP 0072775 (Ciba Geigy AG), Feb. 23, 1983 (Abstract).
van Beek, H.C.A "Light–Induced Colour Changes in Dyes and Materials" *Color Res. and Appl.* 8 176–181, 1983.
Connors, K.A. "Application of a stoichiometric model of cyclodextrin complex formation" *Chemical Abstracts* 98 598 [No. 98:53067g], 1983.
Abstract of Patent, EP 0065617 (IBM Corp.), Dec. 1, 1982 (Abstract).
Derwent Publications Ltd., London, J,A, 0187289 (Honshu Paper Mfg KK), Nov. 17, 1982. (Abstract).
Abstract of Patent, JA 0187289 (Honsho Paper Mfg KK), Nov. 17, 1982 (Abstract).
Abstract of Patent, JA 0185364 (Ricoh KK), Nov. 15, 1982 (Abstract).
Derwent Publications, Ltd., London J5 7139146 (Showa Kako KK) Aug. 27, 1982 (abstract).
Abstract of Patent, JA 0090069 (Canon KK), Jun. 4, 1982 (Abstract).
Derwent Publications, Ltd., London, JA 0061785 (Nippon Senka KK), Apr. 14, 1982 (Abstract).
Fischer, "Submicroscopic contact imaging with visible light by energy transfer" *Appl. Phys. Letter* 40(3), 1982.
Abstract of Patent, JA 0010659 (Canon KK), Jan. 20, 1982 (Abstract).
Abstract of Patent, JA 0010661 (Canon KK), Jan. 20, 1982 (Abstract).
Christen "Carbonylverbindungen: Aldehyde und Ketone," *Grundlagen der Organischen Chemie* 255, 1982.
Derwent Publications Ltd., London, J,A, 0155263 (Canon KK), Dec. 1, 1981. (Abstract).
Abstract of Patent, JA 0155263 (Canon KK), Dec. 1, 1981 (Abstract).
Abstract of Patent, JA 0147861 (Canon KK), Nov. 17, 1981 (Abstract).*
Derwent Publications Ltd., London, J,A, 0143273 (Canon KK), Nov. 7, 1981. (Abstract).*
Abstract of Patent, JP 56143272 (Canon, KK), Nov. 7, 1981 (Abstract).*
Patent Abstracts of Japan, JP 56143274 (Canon Inc.) Nov. 7, 1981, abstract.*
Patent Abstracts of Japan, JA 0136861 (Canon KK), Oct. 26, 1981 (Abstract).*
Abstract of Patent, JA 6133378 (Canon KK), Oct. 19, 1981 (Abstract).*
Abstract of Patent, JA 6133377 (Canon KK), Oct. 19, 1981 (Abstract).*
Abstract of Patent, JA 6093775 (Canon KK), Jul. 29, 1981 (Abstract).*
Derwent Publications Ltd., London, J,A, 0008135 (Ricoh KK), Jan. 27, 1981. (Abstract).*
Derwent Publications Ltd., London, J,A, 0004488 (Canon KK), Jan. 17, 1981. (Abstract).
Abstract of Patent, JA 0004488 (Canon KK), Jan. 17, 1981 (Abstract).
Kirk–Othmer "Metallic Coating," *Encyclopedia of Chemical Technology* 15 241–274, 1981.
Komiyama et al. "Ont–Pot Preparation of 4–Hydroxychalcone β–Cyclodextrin as Catalyst," *Makromol. Chem.* 2 733–734, 1981.
Derwent Publications, Ltd., London CA 1086–719 (Sherwood Medical) Sep. 30, 1980 (abstract).
Derwent Publications Ltd., Database WPI, JP 55 113036 (Ricoh KK), Sep. 1, 1980.
Rosanske et al. "Stoichiometric Model of Cyclodextrin Complex Formation" *Journal of Pharmaceutical Sciences* 69(5) 564–567, 1980.
Semple et al. "Synthesis of Functionalized Tetrahydrofurans," *Tetrahedron Letters* 81 pp. 4561–4564, 1980.
Kirk–Othmer "Film Deposition Techniques," *Encyclopedia of Chemical Technology* 10 247–283, 1980.
Derwent World Patents Index, Derwent Info. Ltd., JP 54158941 (Toyo Pulp KK), Dec. 15, 1979. (Abstract).
Derwent World Patents Index, JP 54117536 (Kawashima F) Sep. 12, 1979.
Derwent Publications Ltd., London, J,A, 0005422 (Fuji Photo Film KK), Jan. 16, 1979 (Abstract).
Drexhage et al. "Photo–bleachable dyes and processes" *Research Disclosure* 85–87, 1979.
"Color imaging devices and color filter arrays using photo–bleachable dyes" *Research Disclosure* 22–23, 1979.
Wolff, N.E., et al. "Electrophotography" *Kirk–Othmer Encyclopedia of Chemical Technology* 8 794–826, 1979.
Derwent Publications Ltd., London, J,A, 0012037 (Pentel KK), Jan. 29, 1977. (Abstract).
Abstract of Patent, JA 0012037 (Pentel KK), Jan. 29, 1977 (Abstract).
Jenkins, P.W. et al. "Photobleachable dye material" Research Disclosure 18 [No. 12932], 1975.
Lamberts, R.L. "Recording color grid patterns with lenticules" Research Disclosure 18–19 [No. 12923], 1975.
Karmanova, L.S. et al. "Light stabilizers of daytime fluorescent paints" *Chemical Abstracts* 82 147 [No. 59971p], 1975.
Prokopovich, B. et al. "Selection of effective photoinducers for rapid hardening of polyester varnish PE–250" *Chemical Abstracts* 83 131 [No. 81334a], 1975.
"Variable Contrast Printing System" Research Disclosure 19 [No. 12931], 1975.
Lakshman "Electronic Absorption Spectrum of Copper Formate Tetrahydrate" *Chemical Physics Letters* 31(2) 331–334, 1975.
Derwent Publications, Ltd., London J4 9131–226 (TNational Cash Register C) Dec. 16, 1974 (abstract).
Chang, I.F., et al. "Color Modulated Dye Ink Jet Printer" *IBM Technical Disclosure Bulletin* 17(5) 1520–1521, 1974.
"Darocur 1173: Liquid Photoinitiator for Ultraviolet Curing of Coatings", 1974.
Hosokawa et al. "Ascofuranone, an antibiotic from Ascochyta," Japan Kokai 73 91.278 (Nov. 28, 1973) *Merck Index* 80 p. 283; abstract 94259t, 1974.
Abstract of patent, NL 7112489 (Dec. 27, 1971).
Gafney et al. "Photochemical Reactions of Copper (II)—1, 3–Diketonate Complexes" *Journal of The Americqal Chemical Society,* 1971.
Derwent Publications, Ltd., London SU 292698–S Jan. 15, 1971 (abstract).

Derwent World Patents Index,CS 120380 (Kocourek, Jan) Oct. 15, 1966.
Tsuda, K., et al. Vinyl Polymerization, CXLVI. The influence of dibenzoyl disulfide derivatives on radical polymerizations *Chemical Abstract* 196 6:29 198, 1966.
R.T. Morrison & R.N. Boyd *Organic Chemistry* pp. 174; 707–711, 1959.
Rigdon, J.E. "In Search of Paper that Spies Can't Copy" *Wall Street Journal*.
Chatterjee,S. et al. "Photochemistry of Carbocyanine Alkyltriphenylborate Salts: Intra–Ion–Pair Electron Transfer and the Chemistry of Boranyl Radicals" *J. Am. Chem. Soc.* 112 6329–6338.
"Assay—Physical and Chemical Analysis of Complexes" AMAIZO.
"Cyclodextrin" AMAIZO.
"Beta Cyclodextrin Polymer (BCDP)" AMIAZO.
"Chemically Modified Cyclodextrins" AMAIZO.
"Cyclodextrin Complexation" American Maize Products Co.
"Monomers" Scientific Polymer Products Inc.
Suppan, Paul "Quenching of Excited States" *Chemistry and Light* 65–69.
Yamaguchi, H. et al. "Supersensitization. Aromatic ketones as supersensitizers" *Chemical Abstracts* 53 107 (d).
Stecher, H. "Ultraviolet–absorptive additives in adhesives, lacquers and plastics" *Chemical Abstracts* 53 14579 (c).
Maslennikov, A.S. "Coupling of diazonium salts with ketones" *Chemical Abstracts* 60 3128c.
Derwent Publications Ltd., London, 4 9128022.
Abstract of Patent, JP 405195450.
Rose, Philip I. "Gelatin," *Encyclopedia of Chemical Technology* 7 488–513.

* cited by examiner

PRINTING APPARATUS AND APPLICATIONS THEREFOR

CROSS REFERENCE TO RELATED APPLICATION

This application claims the benefit of priority to provisional patent application Ser. No. 60/121,560, filed on Feb. 25, 1999.

TECHNICAL FIELD

The present invention relates to a novel printing apparatus and methods for using the same. The present invention further relates to a method of curing photocurable inks, as used in ink jet printers and other printing apparatus, by exposing the photocurable ink to a radiation source, particularly a flat excimer lamp.

BACKGROUND OF THE INVENTION

Many commercially available photoinitiators, including IRGACURE® 369, are presently used in ink compositions to accelerate ink drying in "radiation-drying printing." As used herein, the term "radiation-drying printing" refers to any printing method which utilizes radiation as a drying means. Radiation-drying printing includes, for example, off-set printing operations, such as on a Heidelberg press, flexographic printing, and flat-bed printing. Commercially available photoinitiator systems have a number of shortcomings. First, most of the commercially available photoinitiator systems require a relatively large amount of photoinitiator in the ink composition to fully cure/dry the ink composition. This leads to undesirable extractables within the ink composition. Second, most of the commercially available photoinitiator systems require a high energy radiation source to induce photocuring. Moreover, even with the high energy radiation source, often the cure results are unsatisfactory. Third, many commercially available photoinitiator systems are highly reactive to oxygen and must be used under a nitrogen blanket. Fourth, even with a large amount of photoinitiator and a high energy light source, the commercially available photoinitiator systems require a dry/cure time only accomplished by multiple passes, as many as 15 passes, under a light source, which significantly limits the output of a radiation-drying printing apparatus.

What is needed in the art is a new printing apparatus, which enables substantially instantaneous drying/curing of a photocurable ink without the need for a large amount of photoinitiator in the ink or a high energy radiation source for drying/curing. What is also needed in the art is a method of significantly increasing the output of a radiation-drying printing apparatus due to a reduction in ink drying/curing time.

SUMMARY OF THE INVENTION

The present invention addresses some of the difficulties and problems discussed above by the discovery of a new printing apparatus, which enables instantaneous drying/curing of a photocurable ink composition. The printing apparatus may be used to dry/cure any photocurable ink composition and finds particular utility with ink compositions containing one or more energy-efficient photoinitiators.

The present invention is also directed to methods of using the above-described printing apparatus to print an ink composition onto a substrate. The method comprises printing an ink onto a substrate; and drying/curing the ink with a source of radiation. In one embodiment, the radiation source is a flat excimer lamp.

These and other features and advantages of the present invention will become apparent after a review of the following detailed description of the disclosed embodiments and the appended claims.

DETAILED DESCRIPTION OF THE INVENTION

The present invention is directed to a printing apparatus for printing photocurable ink compositions onto a substrate. The printing apparatus comprising means for applying a photocurable ink composition onto a substrate and means for drying/curing the photocurable ink composition. The means for drying/curing the photocurable ink composition comprises a lamp. The printing apparatus of the present invention enables rapid drying/curing of photocurable ink compositions, resulting in water resistant, cured print.

Figure 1:
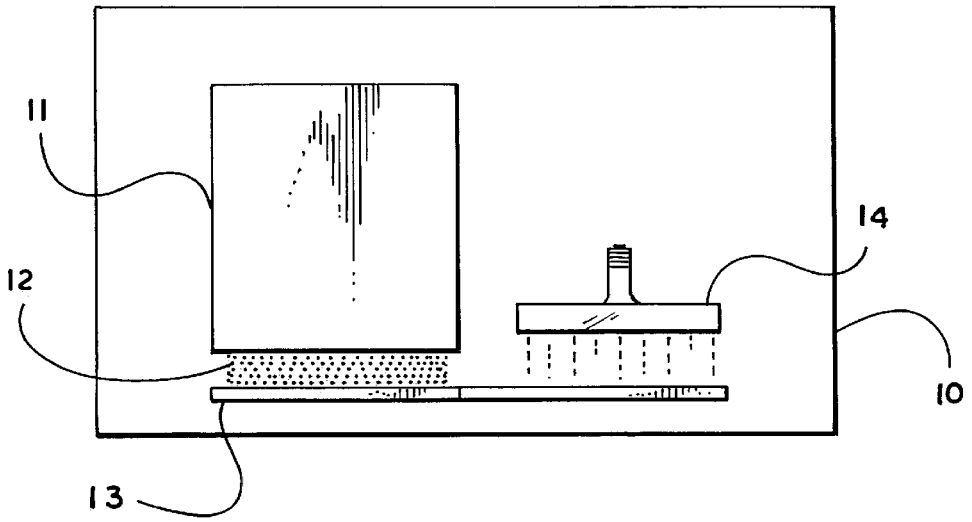
FIG. 1 depicts a printing apparatus of the present invention.

FIG. 1 depicts a printing apparatus 10 of the present invention. The printing apparatus comprises a printing means 11, which applies a photocurable ink composition 12 onto a substrate 13. The printing apparatus further comprises a drying/curing means 14 for drying/curing the photocurable ink composition 12 on the substrate 13.

In one embodiment of the present invention, the printing apparatus comprising means for applying a photocurable ink composition onto a substrate and means for drying/curing the photocurable ink composition, wherein the excimer lamp is a low energy "flat lamp." As used herein, the term "flat lamp" is used to describe a lamp having a thickness substantially less than the width and the length of the lamp. Suitable flat lamps include, but are not limited to, flat excimer lamps available from Heraeus Noblelight GmbH (Hanau, Germany).

Figure 2:
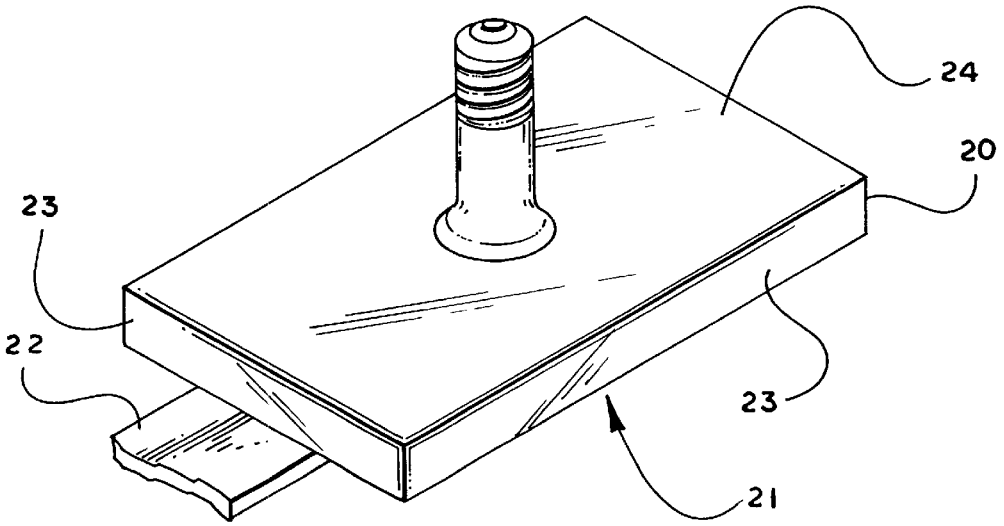
FIG. 2 depicts a flat excimer lamp used in the printing apparatus of the present invention.

FIG. 2 depicts a flat excimer lamp 20 used in one example of the printing apparatus of the present invention. The flat excimer lamp has a flat lower surface 21, which comes into close contact with a substrate 22. The flat excimer lamp has side surfaces 23 and an upper surface 24.

The configuration of the flat excimer lamp enables optimum usage of the radiation emitted by the lamp. Unlike conventional lamps, having various sizes and shapes, a significant amount of radiation from the flat lamp reflects directly off of a printed substrate surface. Further, conventional lamps have various sizes and shapes, which prevent incorporation of the lamp into a printing apparatus. However, the flat lamp requires a relatively low volume of space for operation. In addition, the geometry of the flat lamp allows a large portion of the surface area of the flat lamp to be in close contact with the surface of a printed substrate. The flat lamp may be used in conjunction with a conventional printing apparatus or incorporated into a printing apparatus.

The dimensions of the flat excimer lamp may vary depending upon the desired position of the lamp relative to the printing means. Desirably, the flat lamp has a width of from about 3 inches to about 9 inches; a length of from about 6 inches to about 16 inches; and a thickness of from about ⅜ inch to about 1 inch. More desirably, the flat lamp has a width of from about 3 inches to about 7 inches; a length of from about 8 inches to about 14 inches; and a thickness of from about ⅜ inch to about ⅝ inch. Even more desirably, the flat lamp has a width of about 5 inches; a length of about 12 inches; and a thickness of about ½ inch.

In one embodiment of the present invention, the lamp emits ultraviolet radiation at a wavelength of from about 4 to about 400 nanometers. Desirably, the radiation will have a wavelength of from about 100 to about 420 nanometers, and more desirably will have a wavelength of from 222 to about 420 nanometers. Even more desirably, the radiation will have a wavelength of from about 222 to about 308 nanometers. The radiation desirably will be radiation from a 308 nm 15 W flat excimer lamp, available from Heraeus Noblelight GmbH (Hanau, Germany).

Although the radiation source is desirably a flat excimer lamp, other radiation sources may also be used in the present invention. Other suitable lamps include, but are not limited to, non-flat excimer lamps, mercury lamps, and other specialty doped lamps. Suitable lamps are disclosed in copending U.S. Provisional Patent Application Ser. No. 60/111,950, the subject matter of which has been incorporated into U.S. patent application Ser. No. 09/407,007, filed on Sep. 28, 1999, both of which are assigned to Kimberly Clark Worldwide, Inc., the entirety of which is incorporated herein by reference.

The choice of a specific radiation source allows for the effective tuning of the radiation source to a particular photocurable ink composition. The ink composition may contain one or more photoinitiators, which absorb energy at a wavelength corresponding to the wavelength of the radiation source. Suitable photoinitiators include, but are not limited to, photoinitiators disclosed in copending Provisional Patent Applications Nos. 60/082,143, 60/087,866, 60/102,153, 60/111,950, and 60/121,302, the subject matter of all of which has been incorporated into U.S. patent application Ser. No. 09/407,007, filed on Sep. 28, 1999; U.S. patent application Ser. No. 08/998,464; and U.S. Pat. No. 5,739,175; all of which are assigned to Kimberly Clark Worldwide, Inc., the entirety of which is incorporated herein by reference.

The excimer lamp of the printing apparatus of the present invention emits radiation at a specific wavelength band, which results in the photoinitiators to more efficiently utilize the radiation in the emission spectrum of the radiating source corresponding to the "tuned" wavelength band, even though the intensity of such radiation may be much lower than, for example, radiation from a narrow band emitter, such as an excimer lamp. For example, it may be desirable to utilize a flat excimer lamp, or other radiation emission source, that emits radiation having a wavelength of approximately 222 nm or 308 nm with one or more photoinitiators. Further, it may be desirable to utilize an excimer lamp, or other radiation emission source, that emits radiation having a wavelength of approximately 360 nm or 420 nm with one or more photoinitiators.

In a further embodiment, the present invention is directed to a method of printing an ink composition onto a substrate using an ink jet printing apparatus as described above. The method comprises applying a photocurable ink composition onto a substrate, and drying/curing the photocurable ink composition. The means for drying/curing the photocurable ink composition may comprise a flat excimer lamp as described above.

The printing apparatus of the present invention and the method of printing using the printing apparatus of the present invention has been described above in terms of the means for applying a photocurable ink composition onto a substrate and the means for drying/curing the photocurable ink composition. In addition to the means for applying a photocurable ink composition and the means for drying/curing the photocurable ink composition, the printing apparatus may further comprise other components including, but not limited to, a paper feeder, a printed sheet sorter, etc. In one embodiment of the present invention, the printing apparatus further comprises a housing means for enclosing the means for applying a photocurable ink composition onto a substrate and the means for drying/curing the photocurable ink composition.

Although the printing apparatus of the present invention finds particular applicability in the area of ink jet printing, the printing apparatus of the present invention may be used in any radiation-drying printing process. As used herein, "radiation-drying printing" refers to any printing method, which utilizes radiation as a drying means. Radiation-drying printing includes, for example, off-set printing operations, such as on a Heidelberg press, flexographic printing, and flat-bed printing.

The printing apparatus of the present invention enables increased output due to the efficient drying/curing of the printed substrate. Further, the increased output may be obtained while using a minimal amount of photoinitiator and a low energy light source. The printing apparatus of the present invention enables rapid curing times from 5–10 times faster than the curing times of ink compositions using conventional equipment. The printing apparatus of the present invention enables print speeds, which were at one time thought to be unobtainable. For example, in an open air printing process using a Heidelberg print press and a 15 W flat excimer lamp for photocuring, desirably the printed sheet output is greater than 6,000 sheets per hour. More desirably, the printed sheet output is greater than 8,000 sheets per hour. Even more desirably, the printed sheet output is greater than 10,000 sheets per hour.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

The present invention is further described by the examples which follow. Such examples, however, are not to be construed as limiting in any way either the spirit or scope of the present invention. In the examples, all parts are parts by weight unless stated otherwise.

EXAMPLE 1

Ink Jet Printing of an UV Curable Acrylate Resin Using a Flat Lamp

A printing apparatus comprising an Epson Stylus Color Printer, Model 740, in combination with an excimer lamp was used to print ink compositions onto a paper substrate according to the following method.

The water-based inks were removed by syringe from an Epson color ink jet cartridge, Model S020191). The empty cartridge was flushed with a clear flexographic resin until the resin from the cartridge was colorless. A 9:1 wt/wt mixture of Satomer SR335 (N-lauryl acrylate) and Flexo Resin was prepared. One percent of a photoinitiator having the following structure was added to the mixture:

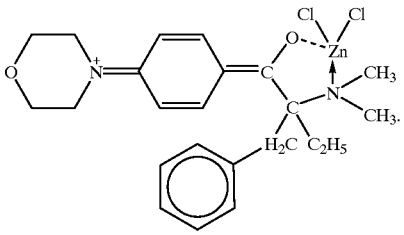

Three inks were prepared from the above mixture: a magenta ink using 5 wt % Intrasperse Red-Violet RH; a yellow ink using 5 wt % Disperse Yellow 42; and a cyan ink using 5 wt % Victoria Blue BO. Each ink was placed within the ink cartridge, which was positioned inside the Epson printer.

Using a paint program, three 2"×2" squares for each ink were printed onto a transparency film and exposed to a flat lamp available from Heraeus Noblelight GmbH (Hanau, Germany) and having a width of about 5 inches; a length of about 12 inches; and a thickness of about ½ inch. An instantaneous cure was observed.

EXAMPLE 2

Ink Jet Printing of an UV Curable Acrylate Resin Using a Cylindrical Excimer Lamp Example 1 was repeated except a cylindrical 308 nm excimer lamp was used in place of the flat lamp. A good cure was observed.

What is claimed is:

1. A printing apparatus comprising:

means for applying a photocurable ink composition onto a substrate; and;

means for drying/curing the photocurable ink composition; wherein said means for drying/curing the photocurable ink composition comprises a flat excimer lamp.

2. The printing apparatus of claim 1, wherein the flat excimer lamp has a width of from about 3 inches to about 9 inches; a length of from about 6 inches to about 16 inches; and a thickness of from about ⅜ inch to about 1 inch.

3. The printing apparatus of claim 2, wherein the flat excimer lamp has a width of from about 3 inches to about 7 inches; a length of from about 8 inches to about 14 inches; and a thickness of from about ⅜ inch to about ⅝ inch.

4. The printing apparatus of claim 3, wherein the flat excimer lamp has a width of about 5 inches; a length of about 12 inches; and a thickness of about ½ inch.

5. The printing apparatus of claim 1, wherein the flat excimer lamp emits radiation at a wavelength of about 308 nm.

6. The printing apparatus of claim 1, wherein the printing apparatus is an ink jet printer.

7. The ink jet printer of claim 6, further comprising housing means for enclosing the means for applying a photocurable ink composition onto a substrate and the means for drying/curing the photocurable ink composition.

8. An ink jet printing apparatus comprising:

means for applying a photocurable ink jet ink composition onto a substrate; and means for drying/curing the photocurable ink jet ink composition; wherein said means for drying/curing the photocurable ink composition comprises a flat excimer lamp.

9. The ink jet printing apparatus of claim 8, wherein the flat excimer lamp has a width of from about 3 inches to about 9 inches; a length of from about 6 inches to about 16 inches; and a thickness of from about ⅜ inch to about 1 inch.

10. The ink jet printing apparatus of claim 9, wherein the flat excimer lamp has a width of from about 3 inches to about 7 inches; a length of from about 8 inches to about 14 inches; and a thickness of from about ⅜ inch to about ⅝ inch.

11. The ink jet printing apparatus of claim 10, wherein the flat excimer lamp has a width of about 5 inches; a length of about 12 inches; and a thickness of about ½ inch.

12. The ink jet printing apparatus of claim 8, wherein the flat excimer lamp emits radiation at a wavelength of about 308 nm.

13. The ink jet printing apparatus of claim 8, further comprising housing means for enclosing the means for applying a photocurable ink composition onto a substrate and the means for drying/curing the photocurable ink composition.

14. A method of printing ink onto a substrate using the printing apparatus of claim 1.

15. A method of printing ink onto a substrate using the printing apparatus of claim 8.

16. A method of printing ink onto a substrate, said method comprising:

applying a photocurable ink composition onto a substrate; and drying/curing the photocurable ink composition with a flat excimer lamp.

17. The method of claim 16, wherein the flat excimer lamp has a width of from about 3 inches to about 9 inches; a length of from about 6 inches to about 16 inches; and a thickness of from about ⅜ inch to about 1 inch.

18. The method of claim 17, wherein the flat excimer lamp has a width of from about 3 inches to about 7 inches; a length of from about 8 inches to about 14 inches; and a thickness of from about ⅜ inch to about ⅝ inch.

19. The method of claim 18, wherein the flat excimer lamp has a width of about 5 inches; a length of about 12 inches; and a thickness of about ½ inch.

20. The printing apparatus of claim 1, wherein the flat excimer lamp emits radiation at a wavelength of from about 100 nm to about 420 nm.

21. The ink jet printing apparatus of claim 8, wherein the flat excimer lamp emits radiation at a wavelength of from about 100 nm to about 420 nm.

* * * * *